US009595781B2

(12) United States Patent
Ueno et al.

(10) Patent No.: US 9,595,781 B2
(45) **Date of Patent: *Mar. 14, 2017**

(54) TERMINAL AND CONNECTOR

(71) Applicant: Molex, LLC, Lisle, IL (US)

(72) Inventors: Hiroshi Ueno, Yamato (JP); Toshihiro Niitsu, Machida (JP); Hirokazu Suzuki, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/156,481

(22) Filed: May 17, 2016

(65) Prior Publication Data

US 2017/0025777 A1 Jan. 26, 2017

Related U.S. Application Data

(63) Continuation of application No. 14/373,221, filed as application No. PCT/US2013/022369 on Jan. 21, 2013, now Pat. No. 9,368,895.

(30) Foreign Application Priority Data

Jan. 19, 2012 (JP) ..... 2012-008626

(51) Int. Cl.
*H01R 13/11* (2006.01)
*H01R 12/79* (2011.01)

(52) U.S. Cl.
CPC ..... *H01R 13/112* (2013.01); *H01R 12/79* (2013.01)

(58) Field of Classification Search
CPC . H01R 13/17; H01R 13/2435; H01R 13/2442
USPC ..... 439/857, 862, 79, 825
See application file for complete search history.

(56) References Cited

U.S. PATENT DOCUMENTS 3,503,036 A * 3/1970 Desso ..... H01R 12/721 439/857
4,043,631 A * 8/1977 Lapes ..... H01R 13/28 439/862
4,354,729 A 10/1982 Grabbe
4,932,903 A * 6/1990 Bonhomme ..... H01R 43/16 439/629
5,004,438 A 4/1991 Cabourne
5,277,621 A 1/1994 Seto
(Continued)

FOREIGN PATENT DOCUMENTS

JP 2005-091126 A 4/2005

*Primary Examiner* — Tulsidas C Patel
*Assistant Examiner* — Marcus Harcum
(74) *Attorney, Agent, or Firm* — James A. O'Malley

(57) ABSTRACT

The terminal has a base portion held by a terminal holding member, and a contact arm portion extending from the base portion and contacting the contact portion of another terminal. In this terminal, the contact arm portion includes a cantilevered first frame portion and second frame portion extending from the base portion, a connecting frame portion connecting a free end of the first frame portion and a free end of the second frame portion, a contact protruding portion formed in the first frame portion, and a contact face formed in the contact protruding portion; and the contact face moves in a parallel direction and maintains contact with a contact face of a contact portion of another terminal when the contact arm portion is elastically deformed by contact with the contact portion of the other terminal.

23 Claims, 8 Drawing Sheets

(56) References Cited

U.S. PATENT DOCUMENTS

| | | | | |
|---|---|---|---|---|
| 5,306,182 | A * | 4/1994 | Fukushima | H01R 23/68 439/857 |
| 6,835,080 | B1 | 12/2004 | Chang | |
| 7,052,336 | B2 * | 5/2006 | Tsai | H01R 13/193 439/342 |
| 7,086,912 | B2 * | 8/2006 | Matsuura | H01R 13/20 439/845 |
| 7,344,387 | B2 | 3/2008 | Shiroyama | |
| 7,771,244 | B1 * | 8/2010 | Ju | H01R 4/022 439/342 |
| 7,927,158 | B2 * | 4/2011 | Kim | H01R 13/2407 439/816 |
| 8,317,551 | B2 | 11/2012 | Aboulkassem | |
| 9,368,895 | B2 * | 6/2016 | Ueno | H01R 12/91 |
| 2006/0276085 | A1 | 12/2006 | Ma | |
| 2009/0305528 | A1 | 12/2009 | Hirata et al. | |
| 2011/0151720 | A1 | 6/2011 | Xie | |
| 2012/0122350 | A1 | 5/2012 | Choi et al. | |

* cited by examiner

TERMINAL AND CONNECTOR

REFERENCE TO RELATED APPLICATIONS

The Present Disclosure is a continuation of U.S. patent application Ser. No. 14/373,221, entitled "Terminal And Connector", filed Jul. 18, 2014, which issued as U.S. Pat. No. 9,368,895 on Jun. 14, 2016, which is a national stage application of International Patent Application No. PCT/US2013/022369, entitled "Terminal And Connector", filed Jan. 21, 2013, which claims priority to prior-filed Japanese Patent Application No. 2012-08626, entitled "Terminal And Connector," filed on Jan. 19, 2012. The content of the aforementioned Patent Applications is incorporated in its entirety herein.

BACKGROUND OF THE PRESENT DISCLOSURE

The Present Disclosure relates, generally, to a terminal and a connector, and, more particularly, to a terminal and connector having a contact face on a contact arm portion which is able to follow and maintain contact with a contact face of another terminal.

In order to connect wiring such as a cable to a circuit board such as a printed circuit board, wire-to-board connectors are used. One example is disclosed in Japanese Patent Application No. 2003-324071, the content of which is incorporated by reference in its entirety herein. When wire-to-board connectors are used, one connector is mounted on a circuit board, and then mated with another connector connected to the end of a cable.

FIGS. 8A and 8B are diagrams showing a terminal with a conventional connector. In this drawing, 863 is the main body portion of the terminal attached to a connector (not shown). A contact portion 864 is connected to the free end of the connector that makes contact with a terminal attached to another connector (also not shown). A thin gold sheet 871 is fixed to the curved surface of the contact portion 864 to conform to the uneven surface of the other terminal. In order to improve conformity to the uneven surface, a recessed portion 869 is press-molded in the surface of the contact portion 864, and the recessed portion 869 is crimp-filled with layers of gold foil 872. In this way, the thin gold sheet 871 can be deformed according to the surface unevenness of the other terminal, and the contact area with the surface of the other terminal can be ensured.

In a conventional terminal, the thin gold sheet 871 has to be fixed to the surface of the contact portion 864 along with gold foil 872. This increases costs. Also, the slender plate-shaped main body portion 863 does not possess sufficient spring action, and it is difficult to increase the contact pressure between the contact portion 864 and the other terminal. Because the thickness and width of the main body portion 863 have to be increased in order to increase the contact pressure between the contact portion 864 and the other terminal, the overall size of the terminal is increased.

SUMMARY OF THE PRESENT DISCLOSURE

The purpose of the Present Disclosure is to solve the aforementioned disadvantages associated with a conventional terminal by providing a low-cost, compact and reliable terminal and connector having a contact face on a contact arm portion which is able to follow and maintain contact with a contact face of another terminal.

The terminal of the Present Disclosure has a base portion held by a terminal holding member and a contact arm portion extending from the base portion and contacting the contact portion of another terminal. In this terminal, the contact arm portion includes a cantilevered first frame portion and second frame portion extending from the base portion, a connecting frame portion connecting a free end of the first frame portion and a free end of the second frame portion, a contact protruding portion formed in the first frame portion, and a contact face formed in the contact protruding portion; and the contact face moves in a parallel direction and maintains contact with a contact face of a contact portion of another terminal when the contact arm portion is elastically deformed by contact with the contact portion of the other terminal.

In another terminal of the Present Disclosure, the contact arm portion includes an open portion whose periphery is defined by the base portion, the first frame portion, the second frame portion, and the connecting frame portion. In another terminal of the Present Disclosure, the contact protruding portion is thicker than the first frame portion. In another terminal of the Present Disclosure, a pair of left and right contact arm portions extend from a single base portion, and are arranged so the contact faces of the contact protruding portions face each other. In another terminal of the Present Disclosure, the contact face is flat.

The Present Disclosure is also a connector having a terminal of the Present Disclosure and a housing including the terminal holding member. This connector is mated with another connector having a terminal. In another connector of the Present Disclosure, the other terminal has a plate-shaped conductive pattern, the contact portion is a rectangular solid member protruding from the surface of the other terminal, and the other contact face is a flat side face of the contact portion.

Because the contact face of the contact arm portion of a terminal of the Present Disclosure is able to follow the contact face of another terminal and maintain contact, an electrical connection with the other terminal can be securely established, and reliability is improved. Further, because the configuration is simple, both the cost and size of the terminal can be reduced.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIGS. 1A and 1B are diagrams showing a connector according to an embodiment of the Present Disclosure, in which FIG. 1A is a perspective view and FIG. 1B is a top view;

FIGS. 2A and 2B are diagrams showing the connector of FIGS. 1A and 1B mounted on a board, in which FIG. 2A is a perspective view from the rear and FIG. 2B is a perspective view from the front;

FIGS. 3A and 3B are diagrams showing another connector according to an embodiment of the Present Disclosure, in which FIG. 3A is a perspective view and FIG. 3B is a top view;

FIGS. 5A and 5B are diagrams showing a terminal according to an embodiment of the Present Disclosure, in which FIG. 5A is a top view and FIG. 5B is a side view;

FIGS. 6A-6D are diagrams showing the essential portions of the terminal of FIGS. 5A and 5B, in which FIG. 6A is a top view, FIG. 6B is a bottom view, FIG. 6C is a perspective view from the rear and FIG. 6D is a perspective view from the front;

FIGS. 7A and 7B are diagrams used to explain the deformity of the essential portions of a terminal according to an embodiment of the Present Disclosure, in which FIG. 7A shows the deformity of essential portions of a terminal according to an embodiment of the Present Disclosure and FIG. 7B shows the deformity of essential portions of a terminal according to a comparative example; and FIGS. 8A and 8B are diagrams showing a terminal with a conventional connector of the prior art, in which FIG. 8A is a plan view and FIGS. 8B is a cross-sectional side view.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 4:
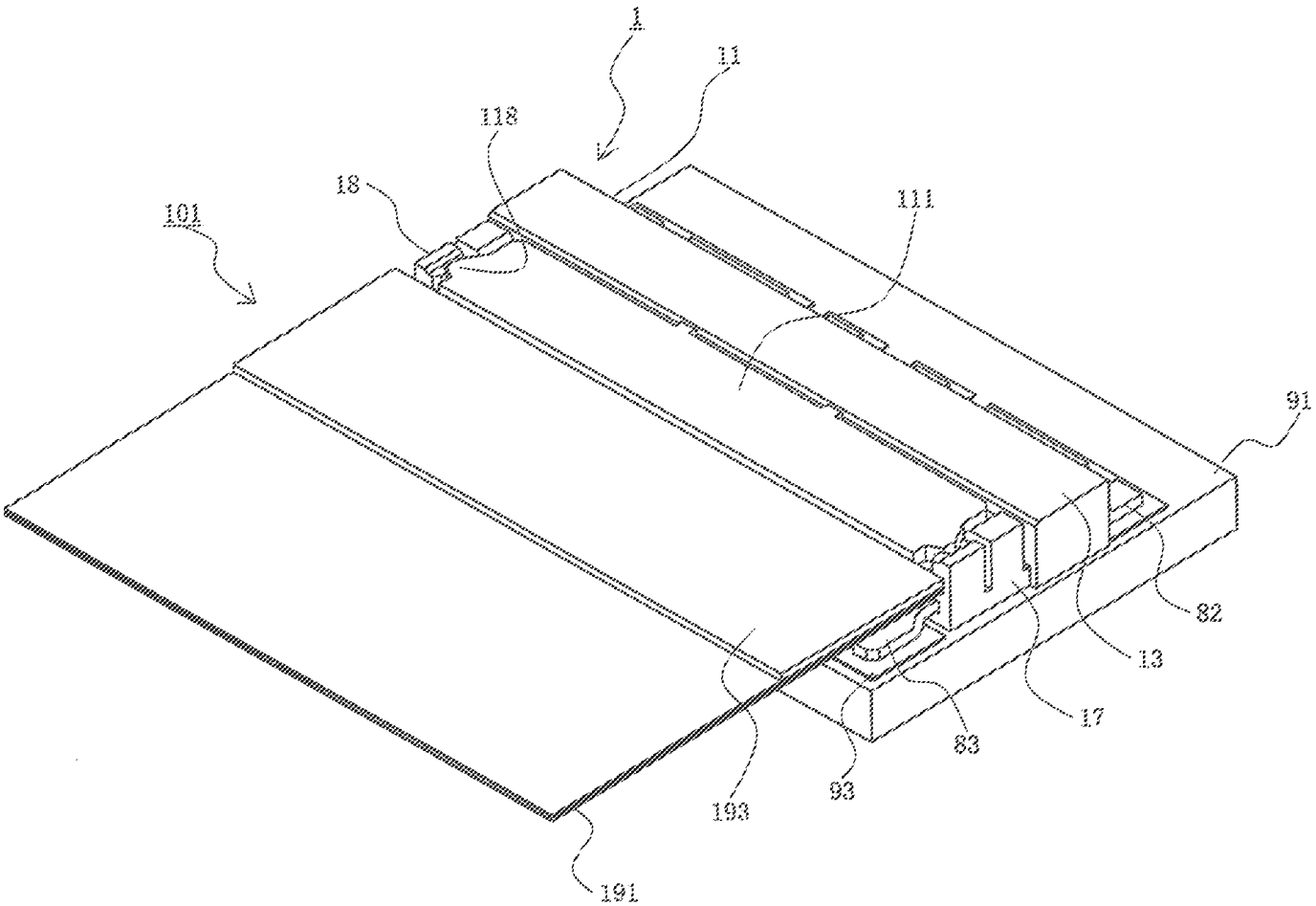
FIG. 4 is a perspective view showing the connector of FIG. 1 mated to that of FIG. 3.

Referring to the Figures in general, and to FIGS. 1A-4 specifically, 1 is a first connector. This is one of the connectors according to the present embodiment. The first connector is for a wire-to-board connector, and is mounted on the surface of a board 91 such as a printed circuit board. Also, 101 is a second connector. This is the other connector according to the present embodiment. The second connector is connected to the end of a cable 191 containing a plurality of wires 192. The first connector 1 and the second connector 101 are mated as shown in FIG. 4.

The board 91 can be any type of board used in electronic devices such as personal computers, cell phones, personal digital assistants (PDAs), digital cameras, video cameras, music players, gaming devices and car navigation systems, and in the electronic components of electric devices such as digital televisions and DVD players. These boards include printed circuit boards and flexible printed circuit boards, and flat cables such as flexible flat cables. In this explanation, a printed circuit board is used inside a cell phone.

The cable 191 can be any type of cable used in electronic devices such as personal computers, cell phones, PDAs, digital cameras, video cameras, music players, gaming devices and car navigation systems, and in the electronic components of electric devices such as digital televisions and DVD players. These cables include twisted cables, coaxial cables, and flat cables. In this explanation, a flexible circuit board or flexible flat cable is used inside a cell phone.

Here, the second connector 101 is a plug connector made out of an insulating material such as a resin, and has a plate-like second main body portion 111 with a rectangular planar shape, and a plate-like conductive portion 160 arranged on the surface of the second main body portion 111 (on the mated side). The conductive portion 160 is separated into a plurality of conductive patterns 161 (four in the example shown in FIGS. 3A and 3B) by a pattern separating portion 112 protruding from the surface of the second main body portion 111.

The conductive patterns 161 function as the other terminal, and are formed, for example, by patterning copper foil using the etching process. These extend longitudinally in the second connector 101 in the short-axis direction of the second main body portion 111, and are arranged parallel to each other laterally in the second connector 101 in the long-axis direction of the second main body portion 111. Adjacent conductive patterns 161 are separated by a pattern separating portion 112.

Each conductive pattern 161 functions as a plurality of conductive wires arranged in parallel. Each one is exposed on the surface of the second main body portion 111, and has a single protruding portion 164 serving as the contact portion. In the example shown in FIGS. 3A and 3B, the two conductive patterns 161 arranged to the inside of the second connector 101 in the width direction are narrow and are assumed to be connected to signal lines for transmitting signals. The two conductive patterns 161 arranged to the outside of the second connector 101 in the width direction are wider and are assumed to be connected to a power line for supplying current and to a ground line for grounding. However, the width of each conductive pattern 161 is not limited to the example shown in FIGS. 3A and 3B. The conductive patterns can have any width. For example, the width of the conductive patterns 161 arranged to the inside in the width direction can be wider, or the width of all of the conductive patterns 161 can be equal. Also, the number of conductive patterns 161 is not limited to the example shown in FIGS. 3A and 3B. Any number of conductive patterns can be formed.

Each protruding portion 164 is a member protruding from the surface of a conductive pattern 161. These can be integrally formed with the conductive patterns 161 using a method such as etching performed using a photolithographic technique. The protruding portions 164 are rectangular solid members extending in the short axis direction of the second main body portion 111, which is the longitudinal direction of the second connector 101. The pair of side faces 164*a* facing each other are flat, and function as contact faces for contacting the first terminal 61 of the first conductor 1. These side faces 164*a* extend in the longitudinal direction of the second connector 101 and are orthogonal to the surface of the conductive patterns 161. The corners at the upper end of the side faces 164*a* can be beveled or inclined. Also, dimensions of the protruding portions 164 can be changed. In this example, the width is approximately 0.5 mm, the height is approximately 0.5 mm, and the length is approximately 1.5 mm.

A second holding portion 113 serving as a band-shaped terminal holding member is made of an insulating material such as a resin and extends over the upper face of the conductive patterns 161 in the width direction of the second connector 101, which is the long axis direction of the second holding portion 113. The conductive patterns 161 are pinched from above and below by the second holding portion 113 and the second main body portion 111, and is secured to the second main body portion 111.

Each conductive pattern 161 has a tail portion 162 extending in the short axis direction of the second main body portion 111. Each tail portion 162 protrudes to the rear and to the outside beyond the second main body portion 111 and the second holding portion 113. The end portion of the cable 191 is connected by soldering each flat electric wire 192 in the cable 191. The width of each electric wire 192 conforms to the width of the corresponding conductive pattern 161 and tail portion 162. As in the case of the conductive patterns 161, the width and number of electric wires 192 are not limited to the example shown in FIGS. 3A and 3B. Any width and number can be selected.

The flat cable 191 has an insulating layer 195 formed on the same face (the face mated with the second connector 101). However, an opening 195*a* is formed in the insulating layer 195 in the end portion of the cable to expose a portion of each electric wire 192 in the opening 195*a* and enable connection of the tail portion 162. A flat, thin reinforcing plate 193 is arranged on the other face in the end portion of the cable 191 (the face on the opposite side of the mated second connector 101). The reinforcing plate 193 can be made of any material. Examples include a metal sheet such as a stainless steel plate, a resin sheet, or a composite sheet containing glass fibers or carbon fibers.

A locking protruding portion 118 is formed on the side face of the second main body portion 111 which serves as another locking portion protruding to the outside. The locking protruding portion 118 engages the locking piece 18 of the first connector 1 to lock the mated first connector 1 and second connector 101.

The first connector 1 is a receptacle connector including a first housing 11, which is molded into a substantially rectangular solid shape using an insulating material such as a resin, and first terminals 61, which are metal terminals attached to the first housing 11.

In the present embodiment, each first terminal 61, as described below, has a tuning fork planar shape, and includes a single base portion 63, a pair of contact arm portions 64 extending forward from the base portion 63, a contact protruding portion 64*d* formed in the contact arm portions 64, and a single tail portion 62 extending to the rear from the base portion 63.

Also, the first housing 11 includes a first holding portion 13, which is a terminal holding member with a slender rectangular solid shape extending in the width direction of the first connector 1, and a first main body portion 15, which is the main body portion extending from the first holding portion 13 to the front of the first connector 1. The first main body portion 15 has a flat bottom plate portion 14, and a mating protruding portion 12 with a slender rectangular solid shape connected to the surface of the bottom plate portion 14 and extending from the first holding portion 13 to the front of the first connector 1. There is more than one mating protruding portion 12 (five in the example shown in FIGS. 1A-2B), and these extend in the longitudinal direction of the first connector 1, and are parallel to each other in the width direction of the first connector 1. Adjacent mating protruding portions 12 are separated by a mating recessed portion 12*a*. In other words, the mating protruding portions 12 are arranged in comb shape. The width of each mating recessed portion 12*a* is the same, but the width of each mating protruding portion 12 does not have to be the same.

Each first terminal 61 is attached to the first housing 11 so that the base portion 63 is held inside the first holding portion 13, the contact arm portions 64 are accommodated by the mating protruding portion 12, a portion of the contact protruding portion 64*d* protrudes into the mating recessed portion 12*a*, and the tail portion 62 extends outward to the rear of the first holding portion 13.

In the example shown in FIGS. 1A-2B, the two first terminals 61 arranged on the inside in the width direction of the first connector 1 are assumed to be connected to signal lines for transmitting signals and have a narrow base portion 63 and tail portion 62, and the two first terminals 61 arranged on the outside in the width direction of the first connector 1 are assumed to be connected to a power line for supplying current and to a ground line for grounding and have a wider base portion 63 and tail portion 62. However, the width of the base portion 63 and tail portion 62 of each first terminal 61 is not limited to the example shown in FIGS. 1A-2B. The terminals can have any width. For example, the width of the base portion 63 and the tail portion 62 of the first terminals 61 arranged to the inside in the width direction can be wider, or the width of the base portions 63 and tail portions 62 of all first terminals 61 can be equal. Also, the number of first terminals 61 is not limited to the example shown in FIGS. 3A and 3B. Any number of terminals can be formed.

Each tail portion 62 is connected to a connecting pad 92 formed on the surface of the board 91 using, for example, solder. This establishes an electrical connection with the conductive traces connected to connecting pads 92. The conductive traces in the board 91 are not shown in the drawings. The width of each connecting pad 92 conforms to the width of the tail portion 62 of the corresponding first terminal 61. The width and number of connecting pads 92 are not limited to the example shown in FIGS. 2A and 2B. Any width and number can be used.

Figure 1A:
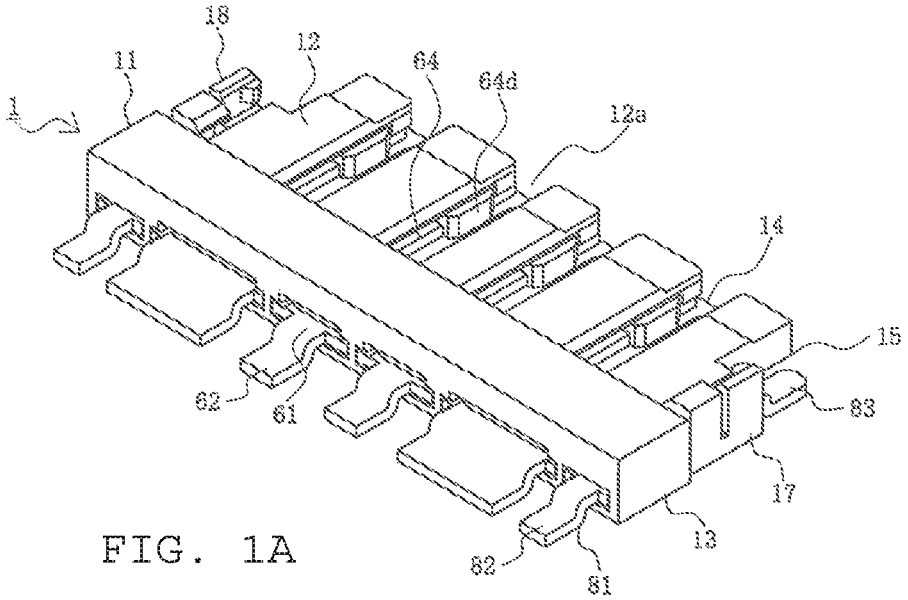
Figure 1B:
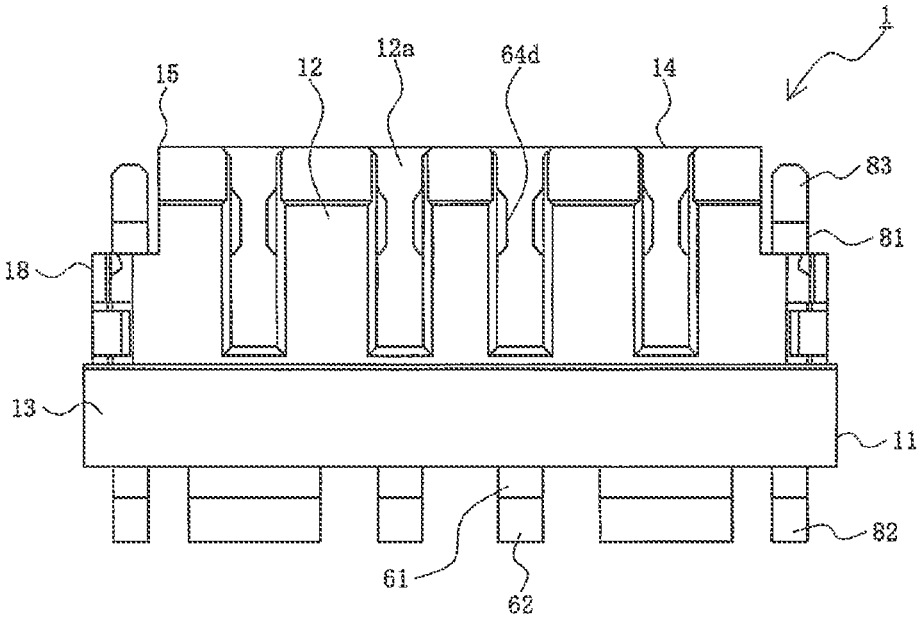
Figure 2A:
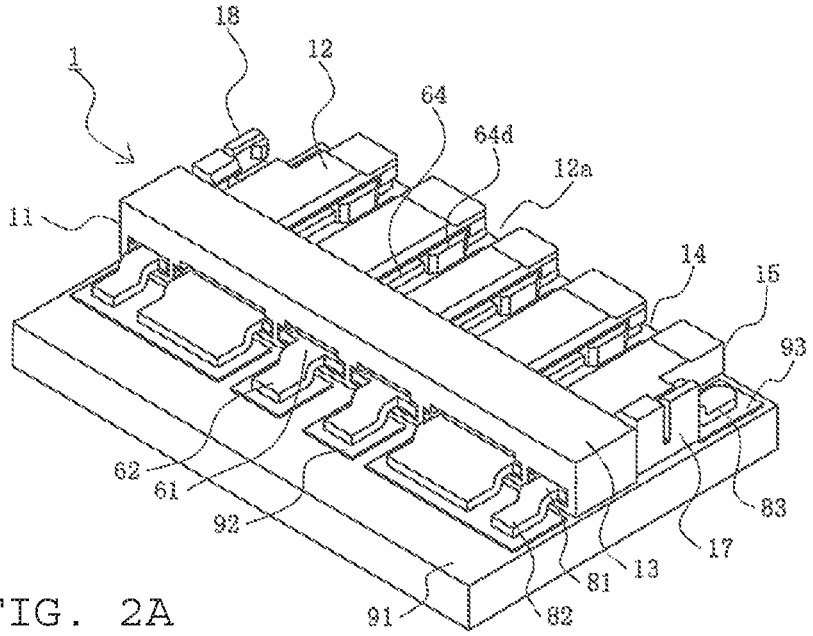
Figure 2B:
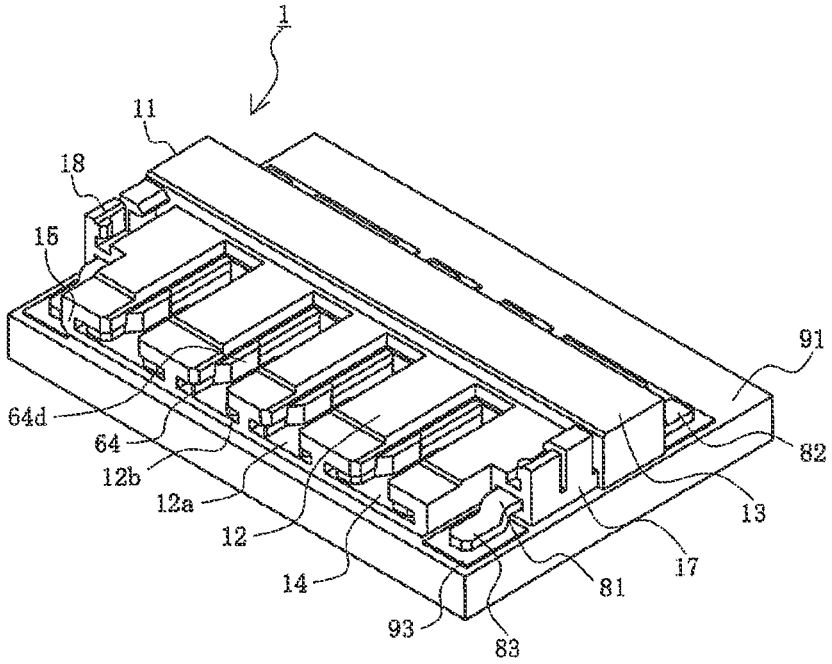
Figure 3A:
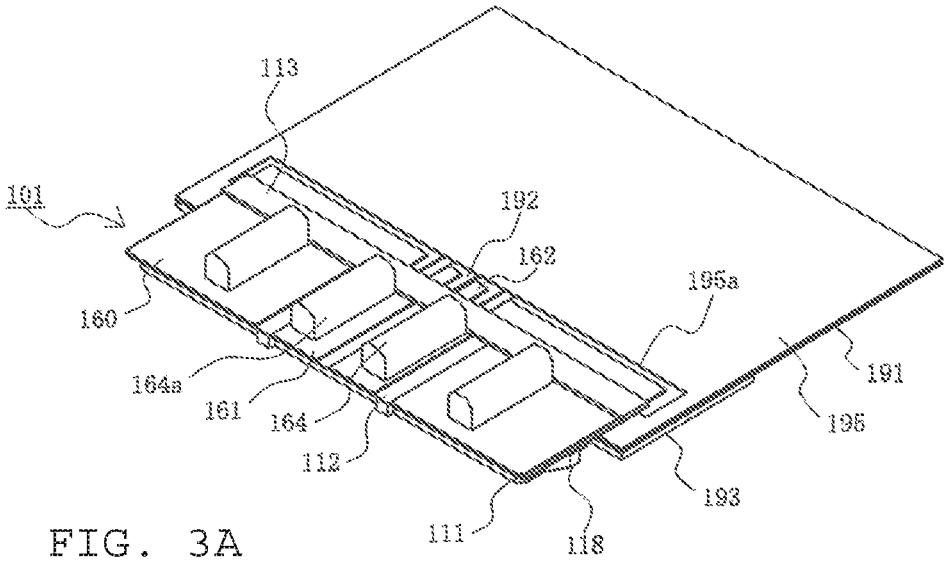
Figure 3B:
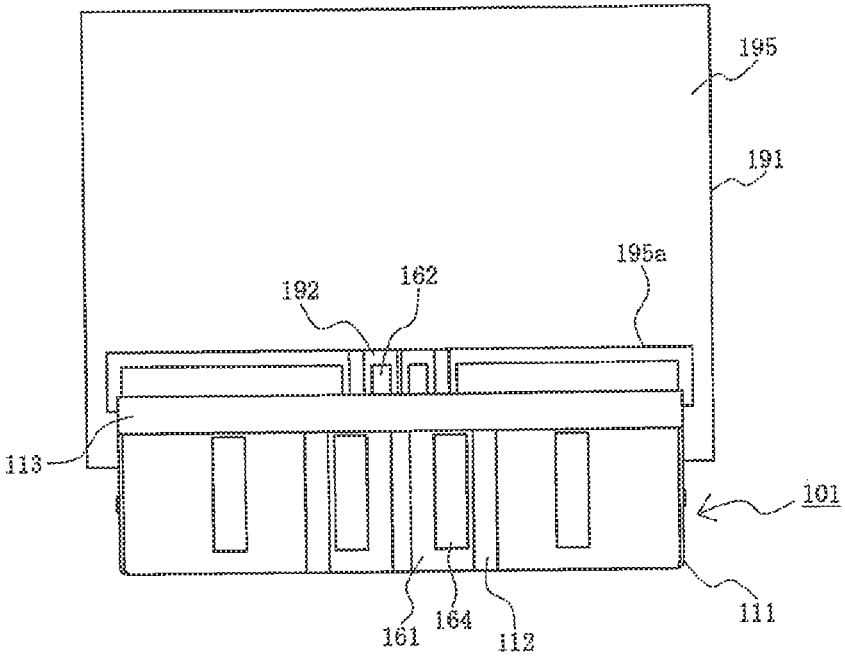

As shown in FIG. 2B, a groove portion 12*b* is formed in the side face of the mating protruding portion 12 on both sides of the mating recessed portions 12*a* in the boundary portion with the bottom plate portion 12. The groove portions 12*b* are formed inside the mating protruding portion 12 and extend in the longitudinal direction of the first connector 1 to serve as a contact arm portion accommodating groove. A contact arm portion 64 of a first terminal 61 is accommodated inside each groove portion 12*b*, and a portion of a contact protruding portion 64*d* protrudes from the side face of the mating protruding portion 12 inside the mating recessed portion 12*a*. As shown in FIG. 1B, the position of each mating recessed portion 12*a* with respect to the width direction of the first connector 1 corresponds to the position of the tail portion 62 of each first terminal 61 with respect to the width direction of the first connector 1. The position of each mating recessed portion 12*a* with respect to the width direction of the first connector 1 also corresponds to the position of each first terminal protruding portion 164 on a second connector 101 mated with a first connector 1 with respect to the width direction of the second connector 101. A pair of contact arm portions 64 on each first terminal 61 is present on both sides of the mating recessed portion 12*a* in the corresponding position.

The first connector 1 also has a pair of metal auxiliary brackets 81. Each auxiliary bracket 81 is arranged to the outside of the first main body portion 15 on the left and right sides, and are held by the first housing 11. The front end of each auxiliary bracket 81 protrudes forward on the outside of the first main body portion 15 and functions as a front connection portion 83. This is secured to a securing pad 93 formed on the surface of the board 91 using, for example, soldering. Also, the rear end of each auxiliary bracket 81 protrudes rearward on the outside of the first holding portion 13 and functions as a rear connection portion 82. This is secured to a connecting pad 92 connected to the tail portion 62 of the adjacent first terminal 61 using, for example, soldering. The rear connection portion 82 does not have to be secured to a connecting pad 92 connected to the tail portion 62 of the adjacent first terminal 61. It can also be secured to a securing pad 93 separate from the connecting pad 92. By securing the front connecting portions 83 of the auxiliary brackets 81 to securing pads 93 or connecting pads 92 on the board 91, the first connector 1 is reliably secured to the surface of the board 91.

The first housing 11 has a side wall portion 17 which is formed to the outside of the auxiliary bracket 81 on the first main body portion 15. The side wall portion 17 includes a locking piece 18 which engages the locking protruding portion 118 of the second connector 101.

When the first connector 1 and the second connector 101 are to be mated, the operator aligns the mating face of the first connector 1 (the face shown in FIG. 1B) with the mating face of the second connector 101 (the face shown in FIG. 3B), the first connector 1 and/or the second connector 101 is moved closer to the other one, each protruding portion 164 of the second connector 101 is inserted into the corresponding mating recessed portion 12*a* in the first connector 1, and the protruding portions 164 are pushed between contact protruding portions 64*d* on contact arm portions 64 protruding into the mating recessed portions 12*a* from the side faces of the mating protruding portions 12 on both sides of the mating recessed portions 12*a*. In this way, the contact protruding portions 64*d* of the contact arm portions 64 of the first terminals 61 are brought into contact with the side faces 164*a* of the protruding portions 164 protruding from the surface of the conductive patterns 161, and an electrical connection is established between corresponding conductive patterns 161 and first terminals 61.

Here, the interval between opposing contact protruding portions 64*d* is pushed apart by the protruding portions 164, and the contact arm portions 64 are elastically deformed. Because the contact protruding portions 64*d* are pushed against the side faces 164*a* of the protruding portions 164 by the spring action generated by the elastically deformed contact arm portions 64, contact between the contact protruding portions 64*d* and the side faces 164*a* can be reliably maintained.

When the first connector 1 and the second connector 101 are mated as shown in FIG. 4, the locking piece 18 on the first connector 1 and the locking protruding portion 118 on the second connector 101 engage each other. In this way, the first connector 1 and the second connector 101 are locked together, and are kept from becoming unintentionally disengaged.

Figure 5A:
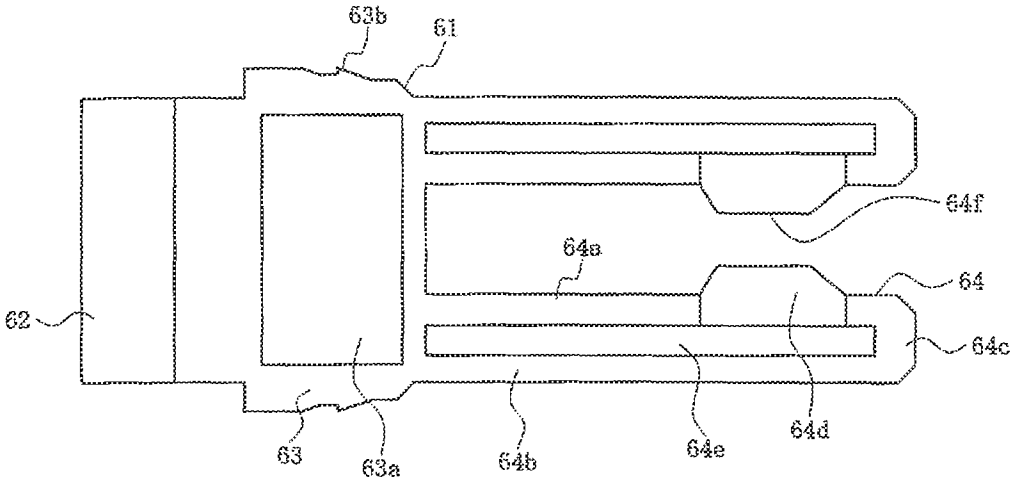
Figure 5B:
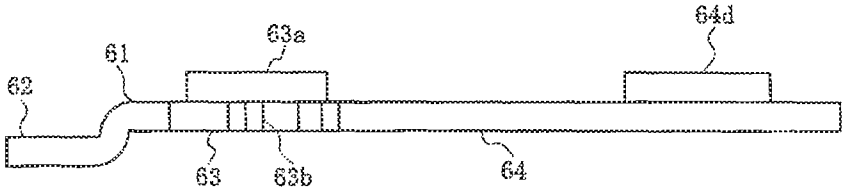

Referring to FIGS. 5A-7B, a first terminal 61, as shown in FIGS. 5A and 5B, is a metal plate with a substantially tuning fork-shaped planar profile. This terminal has a single base portion 63, a pair of contact arm portions 64 extending forward from the base portion 63, and a single tail portion 62 extending rearward from the base portion 63.

In the example shown in FIGS. 5A and 5B, the connecting portion between the tail portion 62 and the base portion 63 has a crank-shaped side profile. However, this side profile can also be linear. Also, an engaging protruding portion 63*a* and an engaging uneven portion 63*b* are formed in the top face and side face of the base portion 63 to hold the engaged first holding portion 13 of the first housing 11. However, the engaging protruding portion 63*a* and engaging uneven portion 63*b* can be omitted.

There does not have to be a pair of left and right contact arm portions 64 as shown in FIGS. 5A and 5B. There can also be a single contact arm portion as shown in FIGS. 6A-6D. Here, when the first connector 1 and the second connector 101 are mated, the contact protruding portion 64*d* of the contact arm portion 64 makes contact with the left or right side face 164*a* of the protruding portion 164 protruding from the surface of the conductive pattern 161, and the contact protruding portion 64*d* of the contact arm portion 64 does not make contact with the other side face 164*a* of the protruding portion 164. In the example shown in FIGS. 6A-6D, depiction of the tail portion 62 has been omitted.

Each contact arm portion 64 is a member integrally formed using a method such as etching performed with a photolithographic technique, and is integrated with the base portion 63. The dimensions of each contact arm portion 64 can be changed. In this example, the width is approximately 0.5 mm, the height is approximately 0.3 mm and the length is approximately 2.5 mm.

Figure 6A:
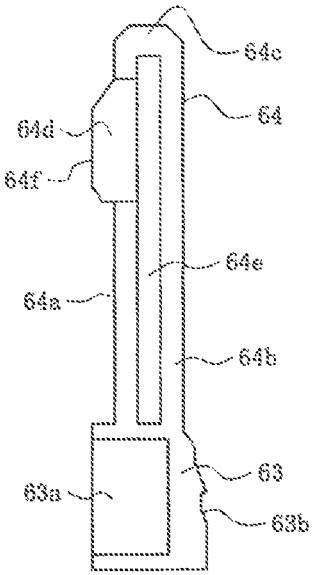
Figure 6C:
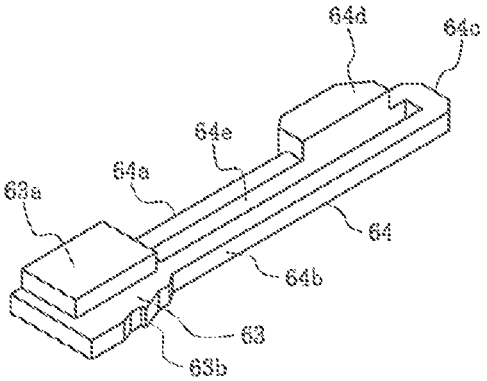
Figure 6B:
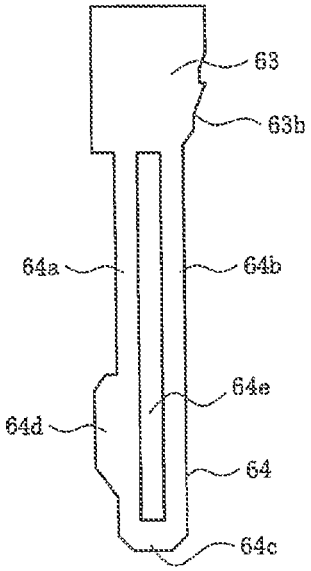

The contact arm portion 64 is a slender, substantially rectangular plate member extending forward from the base portion 63, and a slender slit-shaped open portion 64*e* is formed in the center of the plate in the width direction (longitudinally in FIGS. 6A-6B) and extends in the length direction (laterally in FIGS. 6A-6B). The open portion 64*e* passes through the contact arm portion 64 in the thickness direction of the plate. One side of the open portion 64*e* is a first frame portion 64*a* serving as a slender rod-shaped frame portion extending forward from the base portion 63, and the other side of the open portion 64*e* is a second frame portion 64*b* serving as a slender rod-shaped frame portion extending forward from the base portion 63. The tip of the open portion 64*e* is at the free ends of the first frame portion 64*a* and the second frame portion 64*b*. In other words, it is the connecting frame portion 64*c* serving as the slender rod-shaped frame portion connecting the tips. Put another way, the cantilevered contact arm portion 64 extending forward from the base portion 63 consists of a first frame portion 64*a* and a second frame portion 64*b*, which are two slender cantilevered members extending forward from the base portion 63, and a connecting frame portion 64*c* connecting the free ends of the first frame portion 64*a* and the second frame portion 64*b*. The slit-shaped open portion 64*e* is defined by the base portion 63, the first frame portion 64*a*, the second frame portion 64*b*, and the connecting frame portion 64*c*.

Figure 6D:
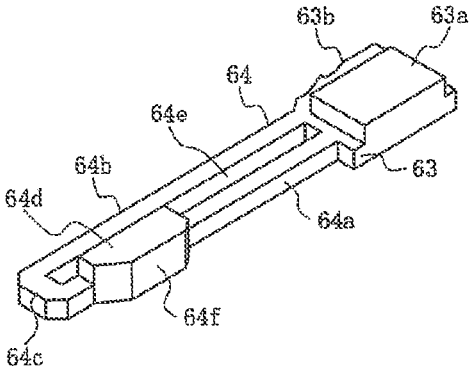

A contact protruding portion 64*d* is formed near the free end of the first frame portion 64*a*. The contact protruding portion 64*d* is thicker than the first frame portion 64*a*, that is, has a greater thickness than the first frame portion 64*a*. It has a trapezoidal planar profile, and protrudes further to the outside than the first frame portion 64*a*. The side face 64*f* of the protruding portion of the contact protruding portion 64*d* is flat and functions as the contact face which makes contact with the side face 164*a* of the protruding portion 164 function as the opposing side face. Because the contact protruding portion 64*d* is thicker than the first frame portion 64*a* as shown in FIG. 6D, the side face 64*f* is also thicker than the side face of the first frame portion 64*a*. As a result, the contact area of the side face 64*f* is greater. This widens the contact area with respect to the side face 164*a* of the protruding portion 164, and can reduce the contact resistance between the contact protruding portion 64*d* and the protruding portion 164. If necessary, the thickness of both the contact protruding portion 64*d* and the first frame portion 64*a* can be equal.

Figure 7A:
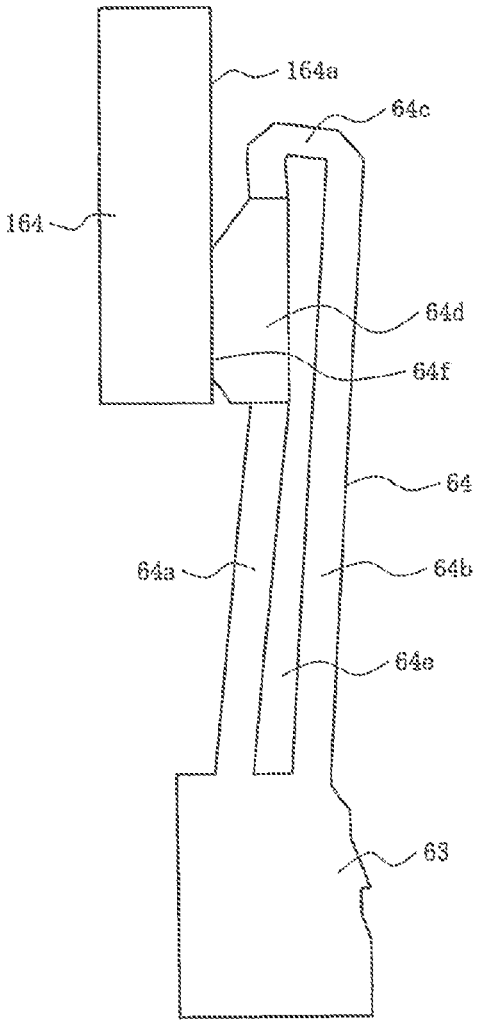

As shown in FIG. 7A, when the first connector 1 and the second connector 101 are mated and an electrical connection has been established between the first terminals 61 and corresponding conductive patterns 161, the side faces 64*f* of the contact protruding portions 64*d* of the contact arm portions 64 of the first terminals 61 make contact with the side faces 164*a* of the protruding portions 164 protruding from the surface of the conductive patterns 161. Here, the contact protruding portions 64*d* are displaced by the protruding portions 164 in the direction opposite that of the protruding portions 164 (to the right in the Figure). As a result, the cantilevered contact arm portions 64 are elastically deformed so that the free end is displaced in the direction opposite that of the protruding portions 164. The deformation of the contact arm portion 64 can be more readily understood by comparing FIG. 7A to FIG. 6A.

When a deformed contact arm portion 64 is more closely examined, it is clear that the direction of extension for the side face 64*f* of the contact protruding portion 64*d* is nearly the same as the direction of extension before deformation. In other words, the side face 64*f* of the contact protruding portion 64*d* remains nearly parallel before and after deformation. Before deformation, as shown in FIGS. 5A and 6A, the longitudinal axis of the contact arm portion 64 is orthogonal to the width direction of the base portion 63 connected at the base end, and the direction of extension of the side face 64*f* of the contact protruding portion 64*d* is nearly parallel to the longitudinal axis of the contact arm portion 64 and orthogonal to the width direction of the base portion 63. After deformation, as shown in FIG. 7A, the longitudinal axis of the contact arm portion 64 is inclined and curved in the direction opposite that of the protruding portion 164 with respect to the width direction of the base portion 63 (to the right in the drawing). However, the direction of extension of the side face 64*f* of the contact protruding portion 64*d* is still nearly orthogonal to the width direction of the base portion 63. In other words, the side face 64*f* of the contact protruding portion 64*d* have moved in the parallel direction while maintaining the same orientation.

Also, when the first connector 1 and the second connector 101 have been mated, the longitudinal axis of the protruding portion 164 of the conductive pattern 161 and the side face 164*a* of the protruding portion are substantially parallel to the longitudinal axis of the mating recessed portion 12*a* of the first connector 1. Therefore, when the protruding portion 164 displaces the contact protruding portion 64*d* in the direction opposite that of the protruding portion 164, the side face 64*f* of the contact protruding portion 64*d* moves on a substantially parallel direction while maintaining the same orientation with respect to the side face 164*a* of the protruding portion 164. As a result, good contact can be maintained with the side face 164*a* of the protruding portion 164. Because, as mentioned above, the side face 164*a* of the protruding portion 164 and the side face 64*f* of the contact protruding portion 64*d* are flat, the side face 64*f* of the contact protruding portion 64*d* can maintain good contact with the side face 164*a* of the protruding portion 164 over a wide area. Therefore, as shown in FIG. 7A, the side face 64*f* of the contact protruding portion 64*d* can maintain good contact with the side face 164*a* of the protruding portion 164 and low contact resistance can be maintained.

The side face 64*f* of the contact protruding portion 64*d* is able to move in a parallel direction because the first frame portion 64*a* in which the contact protruding portion 64*d* has been formed is a cantilevered member that is narrower than the contact arm portion 64 as a whole. This gives it greater flexibility and a greater degree of deformational freedom. As a result, it can be freely deformed near the connecting portion with the base portion 63 or near the connecting portion with the side end of the base portion 64 of the contact protruding portion 64*d* (the lower end in FIG. 7A). This allows the contact protruding portion 64*d* to be displaced in a direction other than the overall direction of displacement of the first frame portion 64*a*. Also, the second frame portion 64*b* functions as a backup, which supports the first frame portion 64*a* from the rear side of the first frame portion 64*a*, that is, from the side opposite that of the protruding portion 164 (the right side in FIG. 7A). Because resisting force is applied to the free end of the first frame portion 64*a*, that is, towards the protruding portion 164, via the connecting frame portion 64*c*, the opposite end of the base portion 63 with respect to the contact protruding portion 64*d* (the upper end in FIG. 7A) is pushed in the direction of the protruding portion 164 (to the left in FIG. 7A).

Figure 7B:
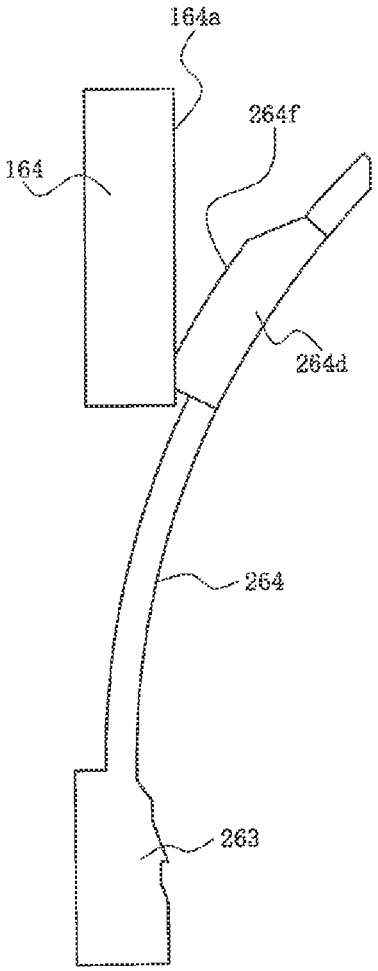
Figure 8A:
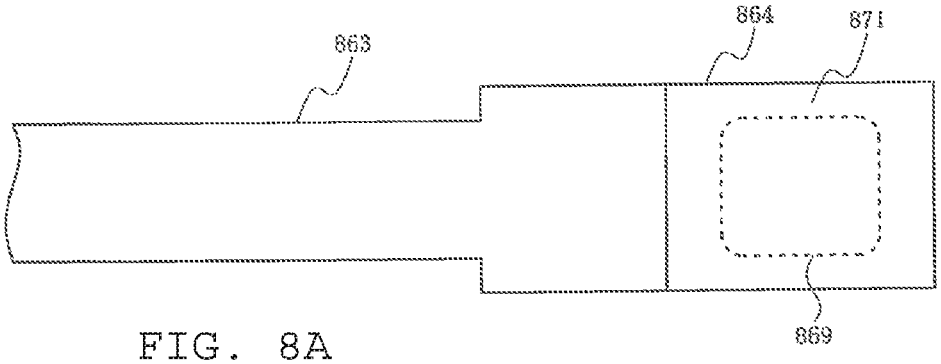
Figure 8B:
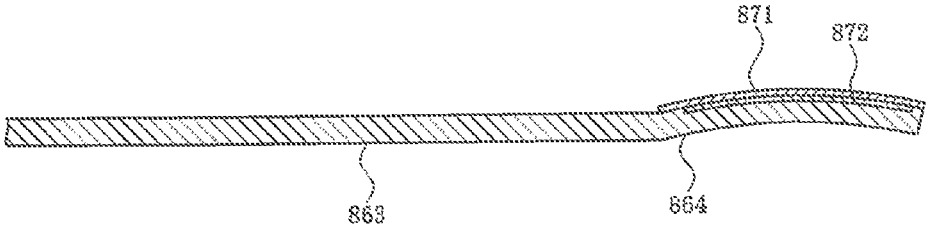
FIG. 8B PRIOR ART

The function of the second frame portion 64*b* can be more readily understood with reference to the comparative example shown in FIG. 7B. In the comparative example shown in FIG. 7B, the connecting frame portion 64*c* and the second frame portion 64*b* have been omitted. In other words, in the comparative example, the contact arm portion 264 is a cantilevered member with the same width as the first frame portion 64*a*, and the base end is connected to a base portion 263 identical to base portion 63. A contact protruding portion 264*d* identical to contact protruding portion 64*d* is formed near the free end of the contact arm portion 264. In the comparative example, when the protruding portion 164 of the conductive pattern 161 pushes to the left in FIG. 7B and the contact protruding portion 264*d* is displaced to the right, the side face 264*f* of the contact protruding portion 264*d* becomes significantly skewed with respect to the side face 164*a* of the protruding portion 164 and most of it moves away from the side face 164*a*. As a result, sufficient contact area cannot be maintained, and contact resistance increases.

In the comparative example shown in FIG. 7B, the skew of the side face 164*a* with respect to the other side face 264*f* can be reduced and the coming apart of the side face 164*a* from the other side face 264*f* can be prevented to a certain extent by reducing the amount of displacement of the contact protruding portion 264*d* to the right. However, because the amount of displacement of the contact arm portion 264 is reduced, the deformation gives the contact arm portion 264 less spring action, and the contact pressure from the side face 264*f* on the other side face 164*a* is reduced. As a result, it is difficult to maintain contact between side face 264*f* and side face 164*a*.

In contrast, because the contact arm portion 64 in the present embodiment has the structure shown in FIGS. 5A-6D, the side face 64*f* of the contact protruding portion 64*d* can maintain contact with the side face 164*a* of the protruding portion 164 over a wide contact area even when the contact arm portion 64 is deformed significantly and the contact protruding portion 64*d* is also displaced significantly. Thus, sufficient contact pressure can be maintained while reliably maintaining contact over a wide contact area. As a result, low contact resistance can be maintained.

In the present embodiment, as mentioned above, a first terminal 61 has a base portion 63 held by a first holding portion 13, and a contact arm portion 64 extending from the base portion 63 and making contact with the protruding portion 164 of the conductive pattern 161. The contact arm portion 64 includes a cantilevered first frame portion 64*a* and second frame portion 64*b* extending from the base portion 63, a connecting portion 64*c* connecting the free end of the first frame portion 64*a* and the free end of the second frame portion 64*b*, a contact protruding portion 64*d* formed on the first frame portion 64*a*, and a side face 64*f* formed in the contact protruding portion 64*d*. The side face 64*f* moves parallel and maintains contact with the side face 164*a* of the protruding portion 164 of the conductive pattern 161 when the contact arm portion 64 is elastically displaced by contact with the protruding portion 164 of the conductive pattern 161.

Because the side face 64*f* of the contact protruding portion 64*d* can follow and maintain contact with the side face 164*a* of the protruding portion 164 of the conductive pattern 161, an electrical connection can be reliably maintained between a first terminal 61 and a conductive pattern 161. Also, because the structure of the first terminal 61 is simple, both its cost and size can be reduced.

Also, the contact arm portion 64 has an open portion 64*e* whose periphery is defined by the base portion 63, the first frame portion 64*a*, the second frame portion 64*b*, and the connecting portion 64*c*. Because this improves the flexibility of the first frame portion 64*a*, the side face 64*f* of the contact protruding portion 64*d* formed in the first frame portion 64*a* can reliably maintain contact with the side face 164*a* of the protruding portion 164 of the conductive pattern 161.

The contact protruding portion 64*d* is thicker than the first frame portion 64*a*. This maintains the flexibility of the first frame portion 64*a* as well as the rigidity of the contact protruding portion 64*d*. It thus maintains flat contact with the side face 64*f*. Also, the area of the side face 64*f* can be widened. As a result, the contact area with the side face 164*a* of the protruding portion 164 of the conductive pattern 161 can be widened, and low contact resistance can be maintained with the side face 164*a* of the protruding portion 164 of the conductive pattern 161.

Also, a pair of left and right contact arm portions 64 extend from a single base portion 63, and are arranged so the contact faces 64*f* of the contact protruding portions 64*d* face each other. In this way, the protruding portion 164 of a conductive pattern 161 can be elastically pinched from both sides, and contact with the protruding portion 164 of the conductive pattern 161 can be reliably maintained.

Also, the first connector 1 has a first terminal 61, and a first housing 11 including a first holding portion 13, and is mated with a second connector 101 with a conductive pattern 161. In this way, the first connector 1 can be reliably mated with the second connector 101 to establish an electrical connection.

Also, the conductive pattern 161 is a plate-shaped, the contact portion 164 is a rectangular solid member protruding from the surface of the other conductive pattern 161, and the side face 164*a* is a flat side face of the contact portion 164. In this way, contact can be maintained between the side face 64*f* of the contact protruding portion 64*d* of the first terminal 61 and the side face 164*a* of the protruding portion 164 of the conductive pattern 161 over a wide contact area, and low contact resistance can be maintained between the first terminal 61 and the conductive pattern 161.

While a preferred embodiment of the Present Disclosure is shown and described, it is envisioned that those skilled in the art may devise various modifications without departing from the spirit and scope of the foregoing Description and the appended Claims.

What is claimed is:

1. A terminal, the terminal comprising:

a base portion; and a pair of left and right contact arm portions extending from the base portion, each contact arm portion including a cantilevered first frame portion extending from the base portion and a cantilevered second frame portion extending from the base portion, each contact arm portion including a connecting frame portion which connects a free end of the first frame portion to a free end of the second frame portion, the first frame portion includes a contact protruding portion, the contact protruding portion includes a contact face, wherein the left and right contact arm portions are arranged so the contact faces of the contact protruding portions face each other.

2. The terminal of claim 1, wherein each contact arm portion further includes an open portion whose periphery is defined by the base portion, the first frame portion, the second frame portion, and the connecting frame portion.

3. The terminal of claim 1, wherein the contact face is flat.

4. The terminal of claim 1, wherein the contact protruding portion is provided on the first frame portion proximate to a position where the first frame portion is connected to the connecting frame portion, whereby, when the contact arm portion is elastically deformed by contact with a contact portion of a separate terminal, the contact face moves in parallel direction and maintains contact with a contact face of the contact portion of the separate terminal.

5. The terminal of claim 1, wherein each contact protruding portion has a thickness which is greater than a thickness of the first frame portion.

6. A terminal, the terminal comprising:

a base portion having an upper surface;

a first contact arm portion extending forwardly from the base portion, the first contact arm portion haying an upper surface which is planar with the upper surface of the base portion, the first contact arm portion including first and second frame portions and a connecting frame portion, the first and second frame portions extending forwardly from the base portion to the connecting frame portion, the base portion, the first and second frame portions and the connecting frame portion define an open portion therebetween, the first frame portion haying a contact protruding portion, the contact protruding portion haying an outward surface which defines a contact face of the contact protruding portion, wherein the contact protruding portion has an upper surface, the upper surface of the contact protruding portion being offset from the upper surface of the first contact arm portion; and a tail portion extending rearwardly from the base portion.

7. The terminal of claim 6, wherein the tail portion has an upper surface, the upper surface of the tail portion being offset from the upper surface of the base portion.

8. The terminal of claim 6, wherein the contact face is flat and is orthogonal to the upper surface of the contact protruding portion.

9. The terminal of claim 6, wherein the first contact arm portion is generally U-shaped in configuration.

10. The terminal of claim 9, wherein the open portion is generally rectangular in configuration.

11. The terminal of claim 6, further comprising a second contact arm portion extending forwardly from the base portion, the second contact arm portion haying an upper surface which is planar with the upper surface of the base portion, the second contact arm portion including first and second frame portions and a connecting frame portion, the first and second frame portions of the second contact arm portion extending forwardly from the base portion to the connecting frame portion of the second contact arm portion, the base portion, the first and second frame portions of the second contact arm portion and the connecting frame portion of the second contact arm portion define an open portion therebetween, the first frame portion of the second contact arm portion having a contact protruding portion, the contact protruding portion of the second contact arm portion having an outward surface which defines a contact face of the contact protruding portion of the second contact arm portion.

12. The terminal of claim 11, wherein the first and second contact arm portions are arranged so the contact faces of the contact protruding portions face each other.

13. The terminal of claim 11, wherein the terminal has a substantially tuning fork-shaped planar profile.

14. The terminal of claim 6, wherein the base portion has an engaging protruding portion extending upwardly from the upper surface thereof.

15. The terminal of claim 6, wherein the base portion has a side surface, and wherein the base portion has an engaging uneven portion formed in the side surface.

16. The terminal of claim 6, wherein the contact protruding portion is provided on the first frame portion proximate to a position where the first frame portion is connected to the connecting frame portion, whereby, when the contact arm portion is elastically deformed by contact with a contact portion of a separate terminal, the contact face moves in parallel direction and maintains contact with a contact face of the contact portion of the separate terminal.

17. A connector, the connector comprising:

a housing having a holding portion; and a plurality of terminals, each terminal having a base portion and a pair of left and right contact arm portions extending from the base portion, each contact arm portion including a cantilevered first frame portion extending from the base portion and a cantilevered second frame portion extending from the base portion, each contact arm portion including a connecting frame portion which connects a free end of the first frame portion to a free end of the second frame portion, the first frame portion includes a contact protruding portion, the contact protruding portion includes a contact face, wherein the left and right contact arm portions are arranged so the contact faces of the contact protruding portions face each other, the base portion being held inside the holding portion of the housing.

18. The connector of claim 17, wherein the housing includes a main body portion, the main body portion extending forward from the holding portion, the main body portion having a bottom plate portion and a plurality of mating protruding portions which extend upwardly from the bottom plate portion, wherein adjacent mating protruding portions are separated by mating recessed portions, wherein the contact arm portions are accommodated by the mating protruding portions, and wherein portions of the contact protruding portions protrude into the mating recessed portions.

19. The connector of claim 17, wherein each terminal has a tail portion extending rearwardly from the base portion, the tail portion extends outward to a rear of the holding portion.

20. The connector of claim 17, wherein the contact protruding portion is provided on the first frame portion proximate to a position where the first frame portion is connected to the connecting frame portion, whereby, when the contact arm portion is elastically deformed by contact with a contact portion of a separate terminal, the contact face moves in parallel direction and maintains contact with a contact face of the contact portion of the separate terminal.

21. A connector, the connector comprising:

a housing having a holding portion; and a plurality of terminals, each terminal having a base portion, a first contact arm portion, and a tail portion, the base portion having an upper surface, the first contact arm portion extending forwardly from the base portion, the first contact arm portion having an upper surface which is planar with the upper surface of the base portion, the first contact arm portion including first and second frame portions and a connecting frame portion, the first and second frame portions extending forwardly from the base portion to the connecting frame portion, the base portion, the first and second frame portions and the connecting frame portion define an open portion therebetween, the first frame portion having a contact protruding portion, the contact protruding portion having an outward surface which defines a contact face of the contact protruding portion, wherein the contact protruding portion has an upper surface, the upper surface of the contact protruding portion being offset from the upper surface of the first contact arm portion, the tail portion extending rearwardly from the base portion, the base portion being held inside the holding portion of the housing.

22. The connector of claim 21, wherein the housing includes a main body portion, the main body portion extending forward from the holding portion, the main body portion having a bottom plate portion and a plurality of mating protruding portions which extend upwardly from the bottom plate portion, wherein adjacent mating protruding portions are separated by mating recessed portions, wherein the contact arm portions are accommodated by the mating protruding portions, and wherein portions of the contact protruding portions protrude into the mating recessed portions.

23. The connector of claim 21, wherein the contact protruding portion is provided on the first frame portion proximate to a position where the first frame portion is connected to the connecting frame portion, whereby, when the contact arm portion is elastically deformed by contact with a contact portion of a separate terminal, the contact face moves in parallel direction and maintains contact with a contact face of the contact portion of the separate terminal.

* * * * *